US007311649B1

(12) United States Patent
Plourde

(10) Patent No.: US 7,311,649 B1
(45) Date of Patent: Dec. 25, 2007

(54) SCULPTED PERFORATED HEADER FOR RECLOSABLE PACKAGES

(75) Inventor: Eric P. Plourde, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/473,396

(22) Filed: Jun. 23, 2006

(51) Int. Cl.
*B31B 1/84* (2006.01)
*B31B 1/64* (2006.01)
*B65D 65/28* (2006.01)

(52) U.S. Cl. ..... 493/213; 493/114; 493/927; 493/930; 383/204

(58) Field of Classification Search ..... 493/213, 493/114, 394, 228, 267, 927, 930; 53/133.6, 53/133.4, 133.8, 412; 383/5, 203, 204, 61.2, 383/63, 64
See application file for complete search history.

(56) References Cited

U.S. PATENT DOCUMENTS 1,200,735 A * 10/1916 Klein ..... 229/314
4,126,085 A * 11/1978 Mowli et al. ..... 493/200
4,503,561 A * 3/1985 Bruno ..... 383/102
5,443,154 A * 8/1995 Hustad et al. ..... 206/213.1
6,440,051 B1 * 8/2002 Lauzon et al. ..... 493/194
6,530,870 B2 * 3/2003 Buchman et al. ..... 493/394
6,652,436 B1 * 11/2003 Yeager et al. ..... 493/213
6,811,529 B1 * 11/2004 Plourde et al. ..... 493/223
6,863,646 B2 * 3/2005 Kinigakis et al. ..... 493/213
2003/0235347 A1 * 12/2003 Kinigakis et al. ..... 383/5
2005/0187089 A1 * 8/2005 Schneider et al. ..... 493/394
2005/0282695 A1 * 12/2005 Yeager ..... 493/213

* cited by examiner

*Primary Examiner*—Rinaldi I. Rada
*Assistant Examiner*—Paul Durand
(74) *Attorney, Agent, or Firm*—Day Pitney LLP

(57) ABSTRACT

A machine direction method of manufacture of reclosable packages is disclosed wherein a semi-circular or similarly shaped perforated pattern is punched in the web in registration with the package side seals. Continuous lines of perforation are punched in the web parallel to the top of the package. The web is folded and shaped into a package with a header which includes the semi-circular perforated pattern and the lines of perforation. A similar transverse direction method of manufacture is disclosed. When the top corner of the header is pulled, the header tears along the shaped perforation until it meets the horizontal line of perforation, thereby avoiding tearing through the area of the header that is sealed to the zipper flange, the header then tears along the horizontal perforation and finally follows the shaped perforation on the opposite end of the package.

20 Claims, 6 Drawing Sheets

SCULPTED PERFORATED HEADER FOR RECLOSABLE PACKAGES

BACKGROUND OF THE INVENTION

1. Field of the Invention

The present invention relates to reclosable packages and a method of manufacture thereof, wherein a semi-circular or similarly shaped perforated pattern is punched in the web in registration with the package side seals. Additionally, continuous lines of perforation are punched in the web parallel to the top of the package. The web is folded and shaped into a package with a header which includes the semi-circular perforated pattern and the lines of perforation. The method includes both machine direction and transverse direction embodiments.

2. Description of the Prior Art

In the prior art, methods of manufacture of reclosable packages with tear-away headers are well-developed and satisfactory for their intended purposes. In particular, form fill seal (FFS) methods are used to produce these reclosable packages which are very advantageous in that they are tamper-evident while maintaining a simple construction with relatively low manufacturing costs.

Typically, slider zipper packages are manufactured on vertical form fill seal (VFFS) machines using low density polyethylene (LDPE) films. The walls of the package extend above the slider to form a tamper-evident header and a line of perforations extends across the header at an elevation below the zipper profile. When the side seals of the package are made, the header becomes sealed to the flanges of the zipper at an elevation above the line of perforations, making it difficult to remove the header.

Additionally, slider operated reclosable packages with a removable header have typically been produced from relatively high cost laminate films as such films lend themselves to laser scoring. The laser scoring can be configured in that the resulting perforations are above the zipper profile in the area of the side seals and drops below the level of the profile along the area of the package top away from the side seals. The consumer can remove the package header to access the slider of the zipper without being impeded by the header film.

On the other hand, unsupported or non-laminate films tend to stretch and do not tear well when laser scored. These films are typically perforated in order to create a removable header. However, the perforations for removable headers for reclosable packages using such material have typically been limited to straight lines above the zipper. This has been acceptable for non-slider applications having a portion of the header above the zipper, but has been open to improvement for slider zipper applications where it is preferable to have the header tear off below the zipper to improve access to the slider.

OBJECTS AND SUMMARY OF THE INVENTION

It is therefore an object of the present invention to provide improvements in reclosable packages, particularly using slider zippers, and the methods of manufacture thereof, while maintaining the relatively low manufacturing costs thereof.

It is therefore a further object of this invention to provide improvements in tamper-evident reclosable packages and the methods of manufacture thereof, particularly with regard to the ease in removing the header.

These and other objects are attained by providing reclosable packages and a method of manufacture thereof, wherein a semi-circular or similarly shaped perforated pattern is punched in the web in registration with the package side seals. The web can be non-laminate or unsupported thereby reducing manufacturing costs. Additionally, continuous lines of perforation are punched in the web parallel to the top of the package. The web is folded and shaped into a package with a header which includes the semi-circular perforated pattern and the lines of perforation. When the top corner of the header is pulled, the header tears along the shaped perforation until it meets the horizontal line of perforation, thereby avoiding tearing through the area of the header that is sealed to the zipper flange, the header then tears along the horizontal perforation and finally follows the shaped perforation on the opposite end of the package.

The method includes both machine direction and transverse direction embodiments.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
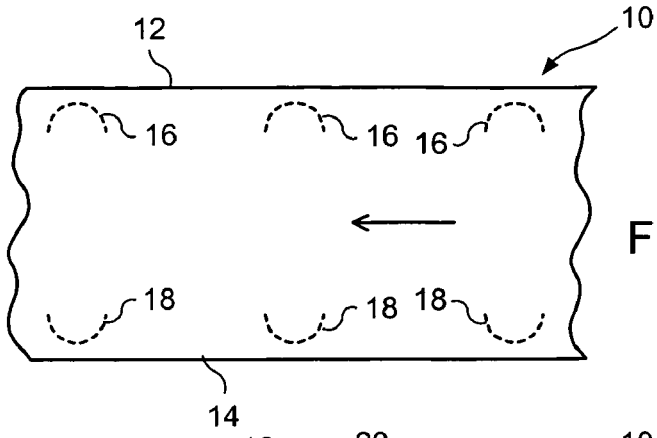
FIG. 1 is a plan view of the web in a first step of a machine direction method of manufacture of the present invention, wherein the semi-circular shaped perforation patterns are formed on the web.

Referring now to the drawings in detail wherein like numerals indicate like elements throughout the several views, one sees that FIGS. 1 and 3-8 illustrate the machine direction (referring to the direction in which the zipper is installed on the web during manufacture) method of manufacture of the present invention, along with the reclosable package 100 manufactured thereby. FIG. 1 illustrates a web (or film) 10 of polymeric material such as is used to make reclosable packages. Web 10 is typically low density polyethylene (LDPE) and is further typically unsupported or non-laminate. However, those skilled in the art will recognize a range of equivalent materials after review of the present disclosure.

Figure 2:
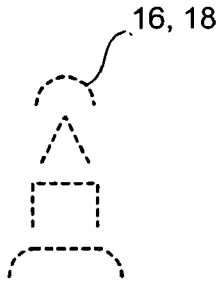
FIG. 2 shows various possible alternative shapes of perforation patterns which can be used in FIG. 1, in place of the semi-circular shaped perforation patterns.

The web 10 is moving in the machine direction as illustrated by the arrow. Web 10 includes lateral edges 12, 14. Rows of semi-circular shaped perforations 16, 18 are punched or similarly formed at package width intervals, in registration with the package side seals, inwardly adjacent from lateral edges 12, 14, respectively. As shown in FIG. 2, various shapes can be substituted for the semi-circular shape of perforations 16, 18 shown in FIG. 1.

Figure 3:
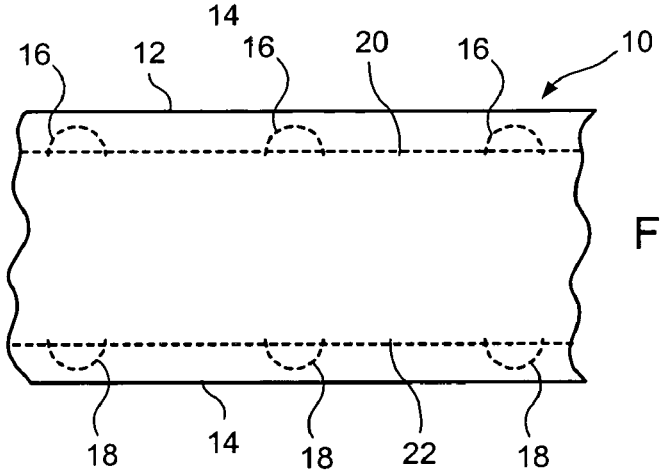
FIG. 3 is a plan view of the web in a second step of a machine direction method of manufacture of the present invention, wherein continuous straight lines of perforation are formed on the web.

As shown in FIG. 3, continuous lines of perforation 20, 22 are punched or similarly formed parallel with lateral edges 12, 14 and intersecting (i.e., passing sufficiently close that tearing along one can easily continue tearing along the other) semi-circular shaped perforations 16, 18, respectively. Alternatively, semi-circular shaped perforations 16 and continuous line of perforation 20 can be formed simultaneously with a first perforation die and semi-circular shaped perforations 18 and continuous line of perforation 22 can be formed simultaneously with a second perforation die. Such consolidation of steps is equally applicable to the alternative embodiments of the present invention.

Figure 4:
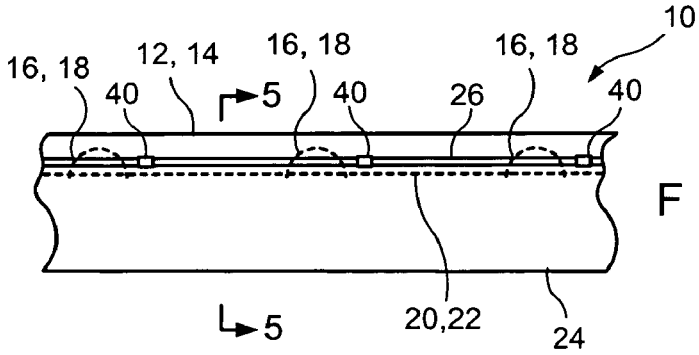
FIG. 4 is a plan view of the web in a third step of a machine direction method of manufacture of the present invention, wherein the web is folded into tube and a zipper is inserted into the resulting fin configuration.
Figure 5:
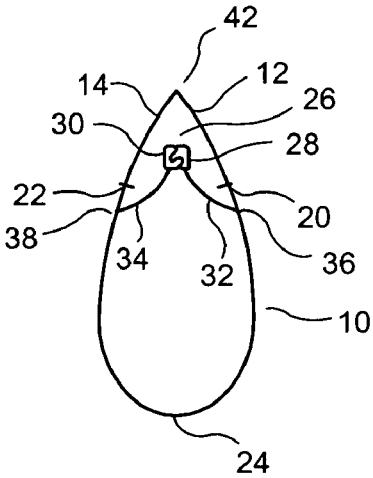
FIG. 5 is a cross-sectional view along plane 5-5 of FIG. 4.
Figure 6:
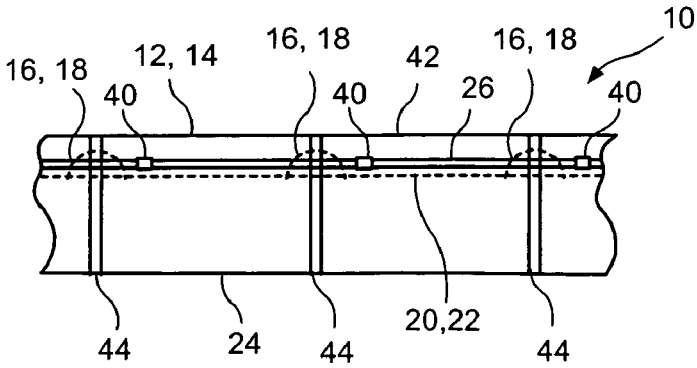
FIG. 6 is a plan view of the web in a fourth step of a machine direction method of manufacture of the present invention, wherein side seals are formed between successive packages.
Figure 7:
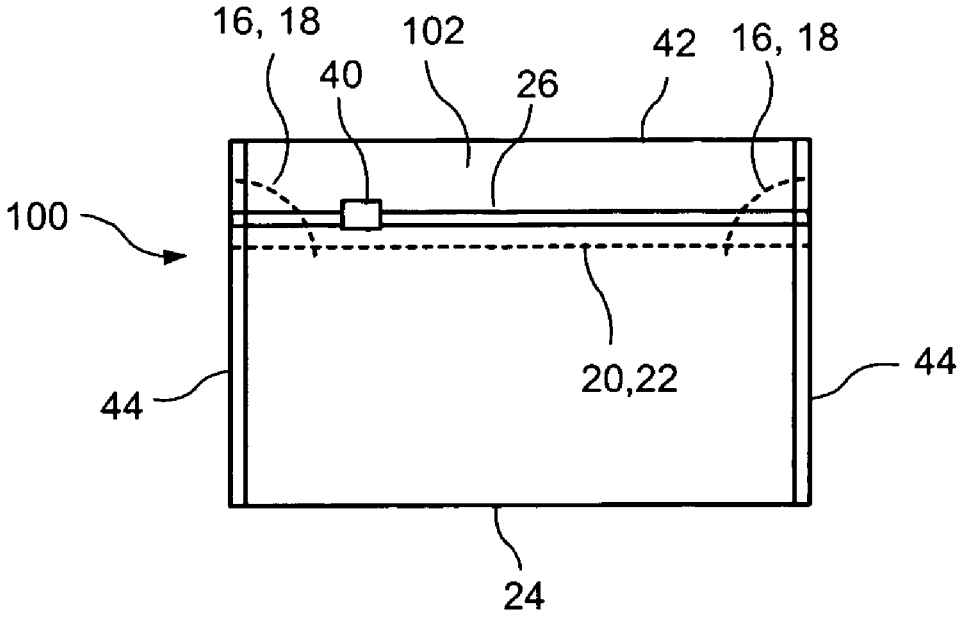
FIG. 7 is a plan view of the package of the present invention, as manufactured by the method illustrated in FIGS. 1-6.
Figure 8:
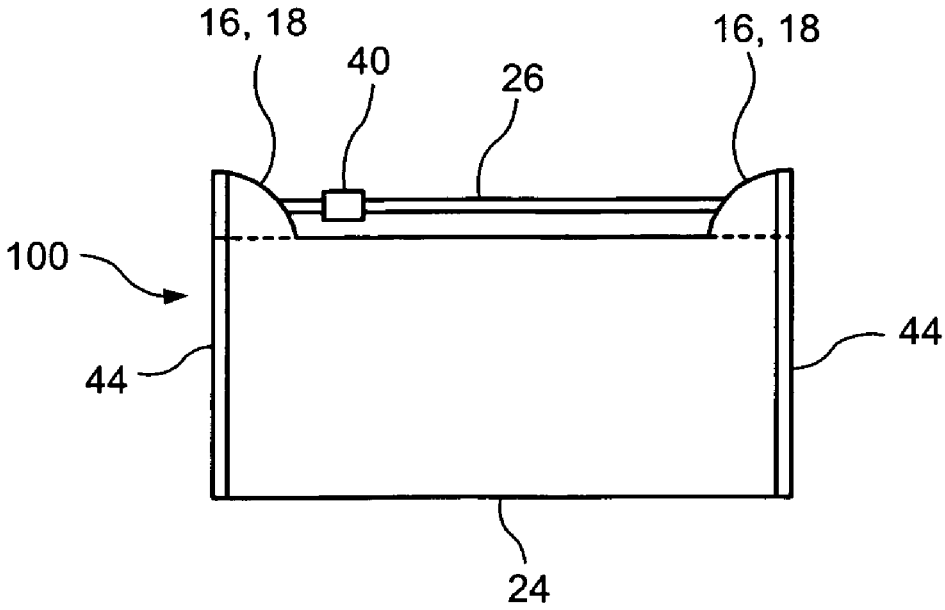
FIG. 8 is a plan view of the package of the present invention, as shown in FIG. 7, but with the header removed.

Thereafter, as shown in FIG. 4, web 10 is folded into a tube thereby bringing lateral edges 12, 14 together, as well as overlapping rows of semi-circular shaped perforations 16, 18 with each other and overlapping continuous lines of perforation 20, 22 with each other. This folding further forms machine direction fold 24 along a central area of web 10. Zipper 26 is inserted into the fin created between lateral edges 12, 14. As shown in the cross-sectional view of FIG. 5, zipper 26 typically includes first and second interlocking profiles 28, 30, including respective first and second flanges 32, 34. Flanges 32, 34 are sealed to web 10 below lines of perforation 20, 22 along respective seal lines 36, 38. Further, zipper 26 includes sliders 40 at package width intervals. Sliders 40 operate in the conventional manner by interlocking first and second interlocking profiles 28, 30 when moved in a first direction and separating first and second interlocking profiles 28, 30 when moved in a second direction. Lateral edges 12, 14 are sealed together to form top seal 42. Thereafter, as shown in FIG. 6, side seals 44 are formed so as to bisect the semi-circular shaped perforations 16, 18 and the tube is cut into individual reclosable packages 100 as shown in FIG. 7.

Reclosable package 100 includes removable header 102 which is bounded on the lower end by lines of perforation 20, 22 and on the sides by the bisected overlap of semi-circular shaped perforations 16, 18 and the top of side seals 44. In order to initially open the reclosable package 100, the consumer pulls one of the top corner of package 100. This results in tearing along the bisected overlap of one set of semi-circular shaped perforations 16, 18, starting at one of the side seals 44 and continuing until the tearing joins the horizontal lines of perforation 20, 22, thereby avoiding tearing through the area of the header 102 that is sealed to the zipper flange. The tearing continuing along horizontal lines of perforation 20, 22 and finally continues along the bisected overlap of the second set of semi-circular shaped perforations 16, 18 on the opposite end of the reclosable package 100 to reach the configuration shown in FIG. 8, thereby allowing access to the zipper 26 and slider 40.

Figure 9:
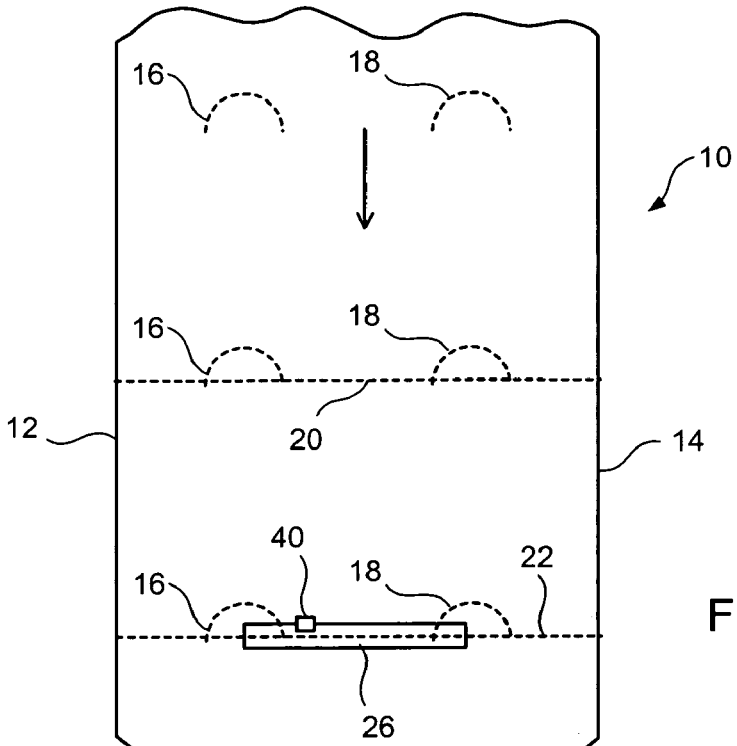
FIG. 9 is a plan view of the web, showing the sequence of steps in the transverse direction method of manufacture of the present invention.
Figure 10:
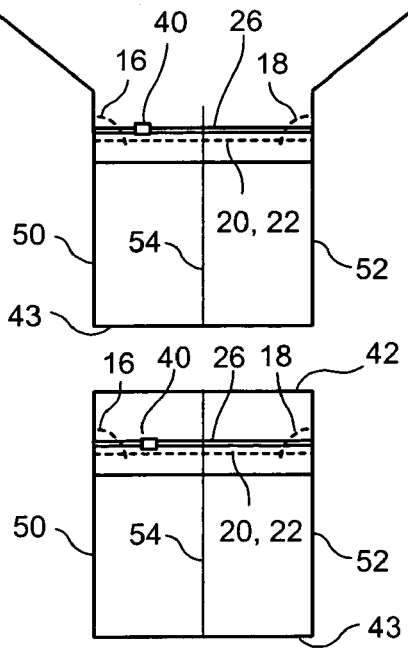
FIG. 10 is a plan view of the package of the present invention, as manufactured in by the method illustrated in FIG. 9.

The series of manufacturing steps is illustrated in FIGS. 9 and 10 for the transverse direction (referring to the direction in which the zipper is installed on the web during manufacture) of manufacture. The web 10 is moving in the machine direction as illustrated by the arrow. Web 10 has a width slightly greater than two package widths and includes lateral edges 12, 14. A pair of semi-circular shaped perforations 16, 18 are punched or similarly formed at package height intervals, the mid-points of semi-circular shaped perforations 16, 18 being positioned at the one quarter and three quarter transverse positions on the web 10, therefore being separated by a package width distance. As with the machine direction embodiment, various shapes shown in FIG. 2 can be substituted for the semi-circular shaped perforations 16, 18.

A single continuous line of perforation 20 is punched or similarly formed transversely across the web 10 and intersecting (i.e., passing sufficiently close that tearing along one can easily continue tearing along the other) semi-circular shaped perforations 16, 18, respectively, and zipper 26, including slider 40 and cut to a length substantially equal to the package width, is placed between the midpoints of semi-circular shaped perforations 16, 18. Flange 32 of first interlocking profile 26 is sealed immediately below the central portion of line of perforation 20. Web 10 is folded in the machine direction at the one quarter and three quarter width positions thereby bringing lateral edges 12, 14 together, as well as folding semi-circular shaped perforations 16 upon themselves, folding semi-circular shaped perforation 18 upon themselves, folding line of perforation 20 upon itself and forming folded sides 50, 52. Lateral edges 12, 14 are sealed together to machine direction seal 54 (which could be either a fin seal or a lap seal). Thereafter, top and bottom seals 42, 43 are formed and the tube is cut into individual reclosable packages 100 as shown in FIG. 10.

Figure 11:
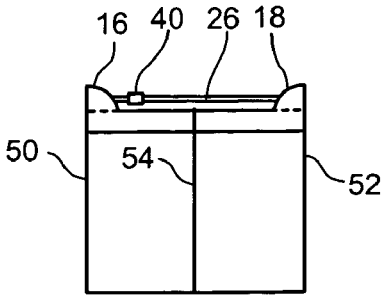
FIG. 11 is a plan view of the package of the present invention, as shown in FIG. 10, but with the header removed.

The header 102 is removed in the way described for the embodiment of FIGS. 1 and 3-8 (with folded sides 50, 52 in place of side seals 44) thereby resulting in the configuration of FIG. 11.

Figure 12:
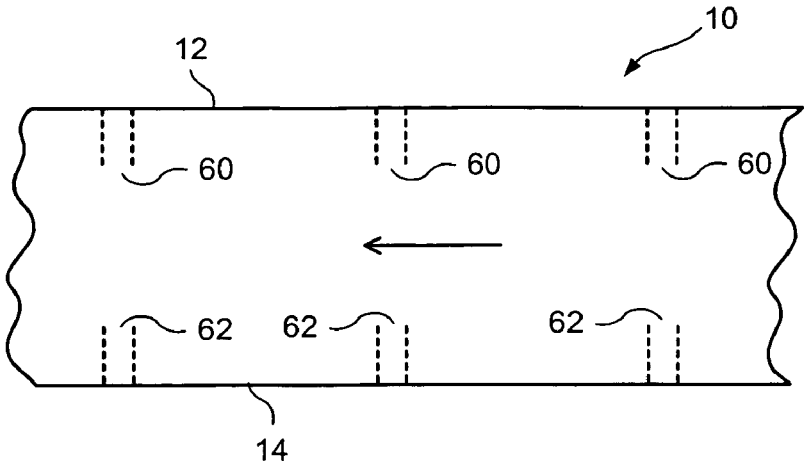
FIG. 12 is a plan view of the web in a first step of an alternative embodiment of the machine direction method of manufacture of the present invention, wherein shaped perforation patterns including parallel line segments are formed on the web.
Figure 13:
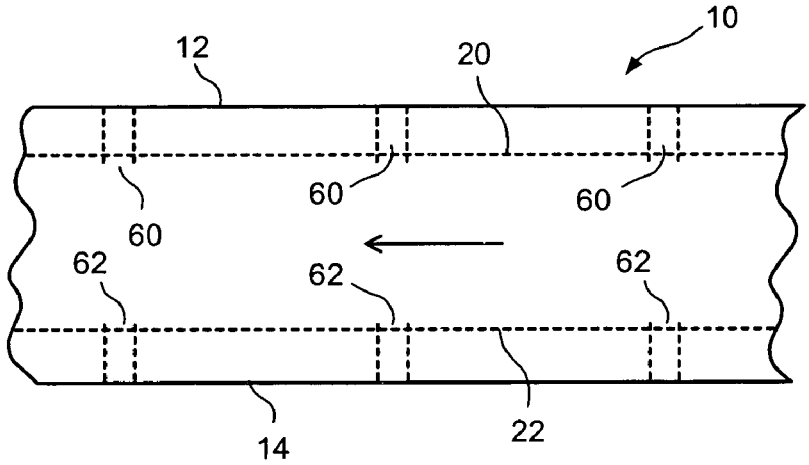
FIG. 13 is a plan view of the web in a second step of the alternative embodiment of the machine direction method of manufacture of the present invention, wherein continuous straight lines of perforation are formed on the web.
Figure 14:
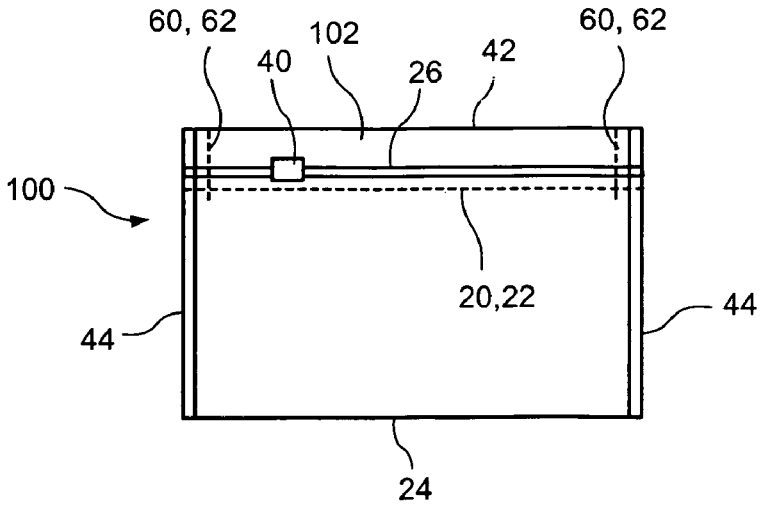
FIG. 14 is a plan view of the package of the present invention, as manufactured by the alternative embodiment of the machine direction method of manufacture, illustrated in FIGS. 12 and 13.
Figure 15:
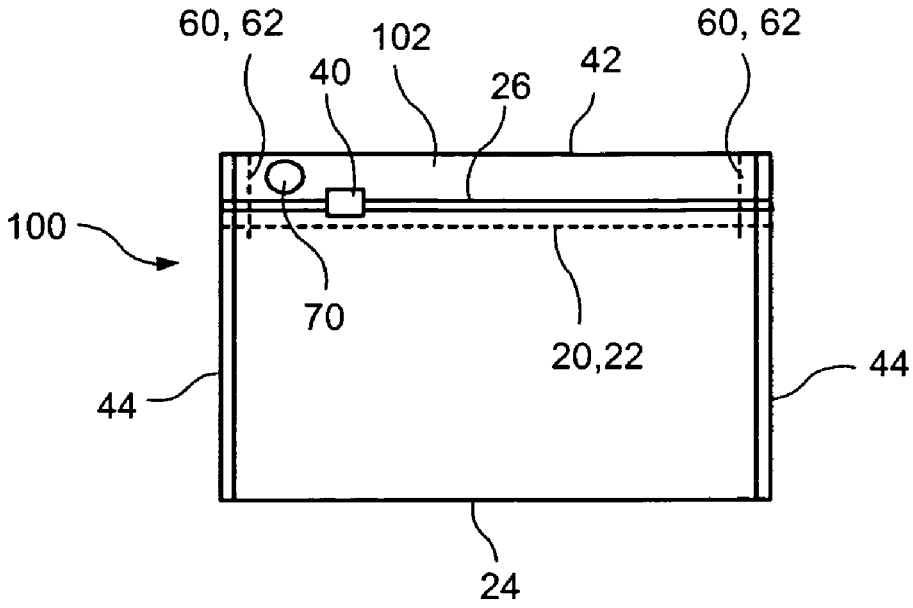
FIG. 15 is a plan view of the package of the present invention, as shown in FIG. 14, but with the header removed.

FIGS. 12 and 13 illustrate alternative embodiment of the machine direction method of manufacture of the present invention wherein pairs 60, 62 of perforated parallel line segments are substituted for semi-circular shaped perforations 16, 18. The steps illustrated in FIGS. 12 and 13 are substituted for the steps shown in FIGS. 1 and 3, while steps illustrated in FIGS. 4 and 6 are maintained thereby resulting in the reclosable package 100 illustrated in FIG. 14. In this configuration, the removable header 102 is removed by the consumer holding the header 102 inboard of the side seals 44 and tearing from the top of the removable header 102, along a first of the pairs 60, 62 of perforated parallel line segments (each pair being overlapped upon itself) to lines of perforation 20, 22 and finally along a second of the pairs 60, 62 of perforated parallel line segments thereby reaching the configuration of FIG. 15.

Figure 16:
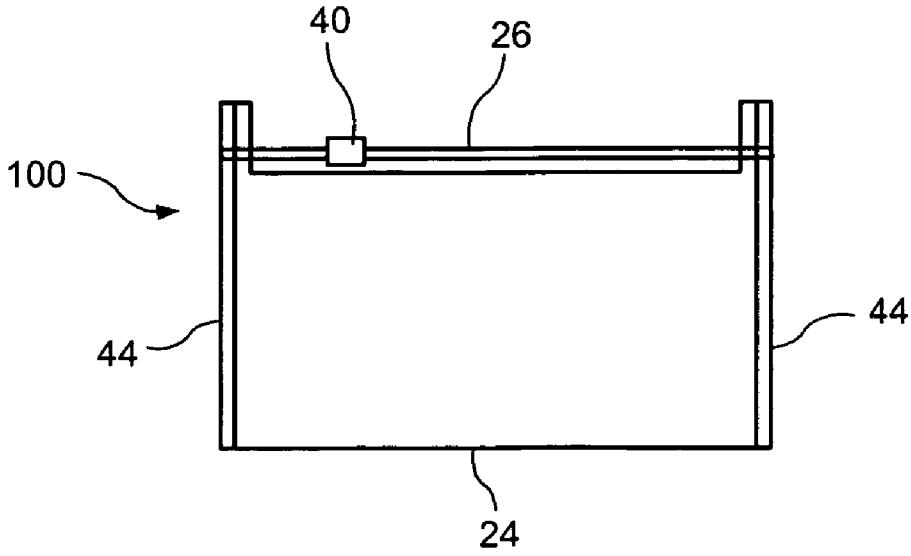
FIG. 16 is a plan view of a further alternative of the package of the present invention, as manufactured by the alternative embodiment of the machine direction method of manufacture, including a perforated or punched finger aperture to aid in removal of the header by the user.

FIG. 16 shows a perforated or excised pull aperture 70, which can be implemented on any of the illustrated embodiments, to facilitate removal of the header 102.

Figure 17:
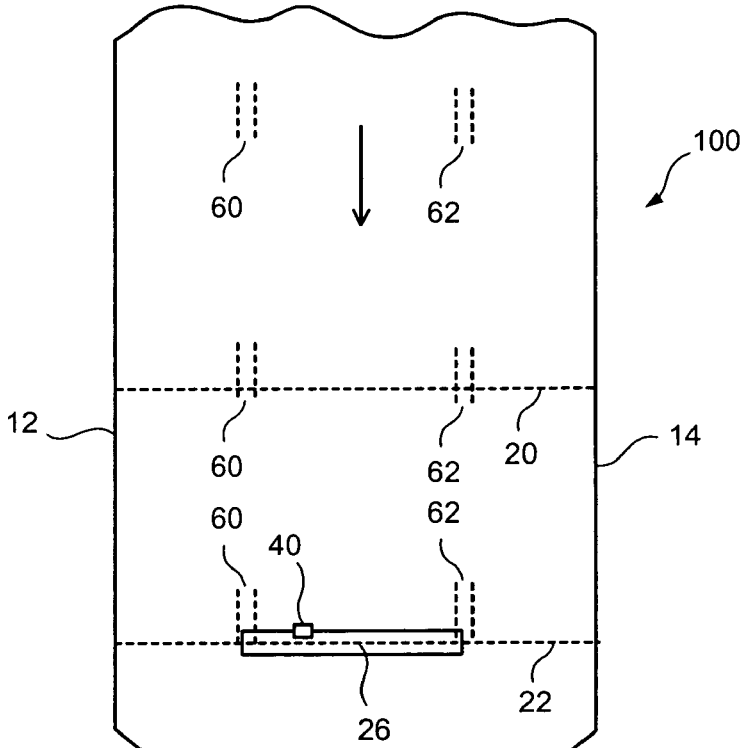
FIG. 17 is a plan view of the web, showing the sequence of steps in an alternative embodiment of the transverse direction method of manufacture of the present invention.
Figure 18:
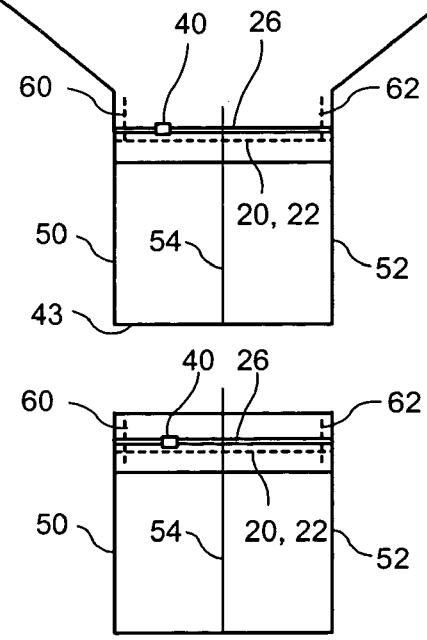
FIG. 18 is a plan view of the package of the present invention, as manufactured in by the method illustrated in FIG. 17.
Figure 19:
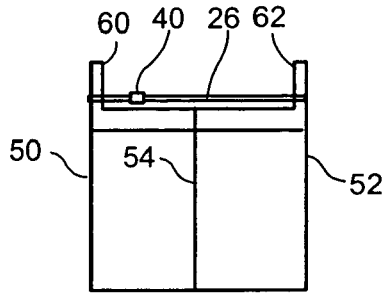
FIG. 19 is a plan view of the package of the present invention, as shown in FIG. 18, but with the header removed.

FIGS. 17-19 illustrate an alternative embodiment of the transverse direction method of manufacture of the present invention. In this embodiment is similar to the transverse direction method of manufacture of FIGS. 9-11 but substitutes pairs 60, 62 of perforated parallel line segments for the semi-circular shaped perforations 16, 18 thereby resulting in a reclosable package 100 with a body and side folds similar to those illustrated in FIG. 11, but with a header 102 configured similar to that illustrated in FIGS. 14 and 15.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of manufacturing reclosable packages, including the steps of:

providing a web including first and second lateral edges;

moving the web in a machine direction;

forming first and second perforated shapes on the web transversely positioned with respect to each other across the web;

forming a perforated line on the web perpendicular with the first and second lateral edges and intersecting the pair of perforated shapes;

sealing a first side of a zipper to the web between a central location of the first perforated shape and a central location of the second perforated shape;

folding the web along a central machine direction to form a first fold bisecting the first perforated shape and to form a second fold bisecting the second perforated shape;

sealing the first lateral edge to the second lateral edge.

2. The method of claim 1 wherein the first and second folds are formed at the one quarter and three quarter transverse positions of the web.

3. The method of claim 2 further including the step of sealing a second side of the zipper to portions of the web folded over the zipper by the folding step.

4. The method of claim 3 further including the step of forming a top seal parallel to the zipper thereby forming a removable header encasing the zipper.

5. The method of claim 4 further including forming a bottom seal parallel and adjacent to the top seal of an adjacent package.

6. The method of claim 5 further including the step of separating successive packages by forming transverse cuts between the top seal of a package and the bottom seal of an adjacent package.

7. The method of claim 6 wherein the zipper includes a first interlocking profile with a first flange and a second interlocking profile with a second flange.

8. The method of claim 7 wherein the zipper further includes a slider which separates the first and second interlocking profiles from each other when moved in an opening direction and interlocks the first and second interlocking profiles when moved in a closing direction.

9. The method of claim 8 wherein the first and second perforated shapes are semi-circular shaped.

10. The method of claim 9 wherein the step of forming the first and second perforated shapes is performed by a die.

11. A method of manufacturing reclosable packages, including the steps of:

providing a web including first and second lateral edges;

moving the web in a machine direction;

forming first series of perforated shapes on the web inwardly adjacent from the first lateral edge;

forming a second series of perforated shapes on the web inwardly adjacent from the second lateral edge;

forming a first perforated line on the web parallel with the first lateral edge and intersecting the first series perforated shapes;

forming a second perforated line on the web parallel with the second lateral edge and intersecting the second series of perforated shapes;

folding the web along a central machine direction location thereby bringing the first and second lateral edges toward each other, aligning the first perforated line with the second perforated line, and aligning the first series of perforated shapes with the second series of perforated shapes;

sealing a zipper between the first and second lateral edges; and forming said seals so as to bisect the aligned perforated shapes of the first and second series.

12. The method of claim 11 further including the step of sealing the first lateral edge to the second lateral edge thereby forming a removable header encasing the zipper.

13. The method of claim 12 wherein the first series of perforated shapes comprises a series of semi-circular shapes.

14. The method of claim 13 wherein the second series of perforated shapes comprises a series of semi-circular shapes.

15. The method of claim 12 wherein the first series of perforated shapes comprises a series of pairs of perforated lines.

16. The method of claim 15 wherein the pairs of perforated lines are parallel to each other and perpendicular to the first and second lateral edges.

17. The method of claim 16 wherein the pairs of perforated lines are parallel to each other and perpendicular to the first and second lateral edges.

18. The method of claim 12 wherein the steps of forming the first and second series of perforated shapes are performed by a die.

19. The method of claim 12 wherein the zipper includes a first interlocking profile with a first flange and a second interlocking profile with a second flange.

20. The method of claim 19 wherein the zipper further includes a slider which separates the first and second interlocking profiles from each other when moved in an opening direction and interlocks the first and second interlocking profiles when moved in a closing direction.

* * * * *